US011767584B2

(12) United States Patent
Sano

(10) Patent No.: US 11,767,584 B2
(45) Date of Patent: Sep. 26, 2023

(54) SOFT MAGNETIC POWDER, DUST CORE, MAGNETIC ELEMENT, ELECTRONIC APPARATUS, AND MOVABLE BODY

(71) Applicant: Seiko Epson Corporation, Tokyo (JP)

(72) Inventor: Toshiki Sano, Hachinohe (JP)

(73) Assignee: SEIKO EPSON CORPORATION

( * ) Notice: Subject to any disclaimer, the term of this patent is extended or adjusted under 35 U.S.C. 154(b) by 0 days.

(21) Appl. No.: 17/741,505

(22) Filed: May 11, 2022

(65) Prior Publication Data

US 2022/0364210 A1 Nov. 17, 2022

(30) Foreign Application Priority Data

May 12, 2021 (JP) ..... 2021-081263

(51) Int. Cl.

| | |
|---|---|
| ***C22C 38/32*** | (2006.01) |
| ***C22C 38/14*** | (2006.01) |
| ***C22C 38/10*** | (2006.01) |
| ***C22C 38/06*** | (2006.01) |
| ***C22C 38/02*** | (2006.01) |
| ***H01F 1/20*** | (2006.01) |
| ***H01F 27/255*** | (2006.01) |
| ***H01F 41/02*** | (2006.01) |
| ***H01F 1/147*** | (2006.01) |

(52) U.S. Cl.

CPC ..... *C22C 38/32* (2013.01); *C22C 38/02* (2013.01); *C22C 38/06* (2013.01); *C22C 38/10* (2013.01); *C22C 38/14* (2013.01); *H01F 1/14791* (2013.01); *H01F 1/20* (2013.01); *H01F 27/255* (2013.01); *H01F 41/0246* (2013.01); *C22C 2200/02* (2013.01); *C22C 2202/02* (2013.01)

(58) Field of Classification Search

CPC . C22C 2200/02; C22C 2202/02; C22C 38/02; C22C 38/06; C22C 38/10; C22C 38/14; C22C 38/32; H01F 1/14791; H01F 1/20; H01F 27/255; H01F 41/0246

See application file for complete search history.

(56) References Cited

U.S. PATENT DOCUMENTS

2016/0298216 A1 10/2016 Kino et al.

FOREIGN PATENT DOCUMENTS

JP 2014-169482 A 9/2014
JP 2014169482 A * 9/2014 ..... B22F 9/002

OTHER PUBLICATIONS

FeSiBCrC amorphous magnetic powder fabricated by gas-water combined atomization (Year: 2020).*
Microstructure and magnetic properties of FeSiBCrC soft magnetic alloy manufactured by selective laser melting (Year: 2021).*
Passivation layer for the magnetic property enhancement of Fe72.8Si11.2B10.8Cr2.3C2.9 amorphous powder (Year: 2015).*

* cited by examiner

*Primary Examiner* — Jenny R Wu
(74) *Attorney, Agent, or Firm* — Harness, Dickey & Pierce, P.L.C.

(57) ABSTRACT

Provided is soft magnetic powder containing an amorphous metal particle having a composition expressed by a compositional formula $Fe_{100-a-b-c-d-e-f-g}Cr_aSi_bB_cC_dAl_eTi_fCo_g$. Here, a, b, c, d, e, f, and g are that express atom %, $0<a\leq3.0$, $5.0\leq b\leq15.0$, $7.0\leq c\leq15.0$, $0.1\leq d\leq3.0$, $0<e\leq0.016$, $0<f\leq0.009$, and $0\leq g\leq0.025$.

5 Claims, 6 Drawing Sheets

SOFT MAGNETIC POWDER, DUST CORE, MAGNETIC ELEMENT, ELECTRONIC APPARATUS, AND MOVABLE BODY

The present application is based on, and claims priority from JP Application Serial Number 2021-081263, filed May 12, 2021, the disclosure of which is hereby incorporated by reference herein in its entirety.

BACKGROUND

1. Technical Field

The present disclosure relates to soft magnetic powder, a dust core, a magnetic element, an electronic apparatus, and a movable body.

2. Related Art

JP-A-2014-169482 discloses iron-based metal glass alloy powder expressed by a compositional formula $(Fe_{1-s-t}Co_sNi_t)_{100-x-y}\{(Si_aB_b)_m(P_cC_d)_n\}_xM_y$, wherein x, y, s, and t in the compositional formula are $19 \le x \le 30$, $0 < y \le 6$, $0 \le s \le 0.35$, $0 \le t \le 0.35$, and $s+t \le 0.35$. Further, to the iron-based metal glass alloy powder, at least one or more selected from Cr and Zr are added as an anti-corrosive modification component, and at least one or more selected from V, Ti, Ta, Cu, and Mn are added as an anti-corrosive modification sub component.

The iron-based metal glass alloy powder as described above contains an amorphous single phase, and hence a magnetic property is improved. Further, the anti-corrosive modification component and the anti-corrosive modification sub component are added to the iron-based metal glass alloy powder, and hence anti-corrosiveness and specific resistance are improved.

A compact such as a dust core manufactured from soft magnetic powder is used in a high frequency region in many cases. In a high frequency region, core loss of the compact tends to increase, and hence it is required to suppress core loss. A composition of the soft magnetic powder is likely to contribute to core loss, particularly, to hysteresis loss. In order to suppress hysteresis loss, it is required to reduce a coercive force of the soft magnetic powder.

However, the iron-based metal glass alloy powder described in JP-A-2014-169482 does not consider how the composition has influence on a coercive force. Thus, it is required to achieve soft magnetic powder with a reduced coercive force as well as a satisfactory magnetic property due to an amorphous alloy.

SUMMARY

Soft magnetic powder according to an application example of the present disclosure contains an amorphous metal particle having a composition expressed by a compositional formula $Fe_{100-a-b-c-a-e-f-g}Cr_aSi_bB_CC_dAl_eTi_fCo_g$, wherein a, b, c, d, e, f, and g are that express atom %, $0<a\le3.0$, $5.0\le b\le15.0$, $7.0\le c\le15.0$, $0.1\le d\le3.0$, $0<e\le0.016$, $0<f\le0.009$, and $0\le g\le0.025$.

A dust core according to an application example of the present disclosure contains the soft magnetic powder according to the application example of the present disclosure.

A magnetic element according to an application example of the present disclosure includes the dust core according to the application example of the present disclosure.

An electronic apparatus according to an application example of the present disclosure includes the magnetic element according to the application example of the present disclosure.

A movable body according to an application example of the present disclosure includes the magnetic element according to the application example of the present disclosure.

DESCRIPTION OF EXEMPLARY EMBODIMENTS

Figure 1:
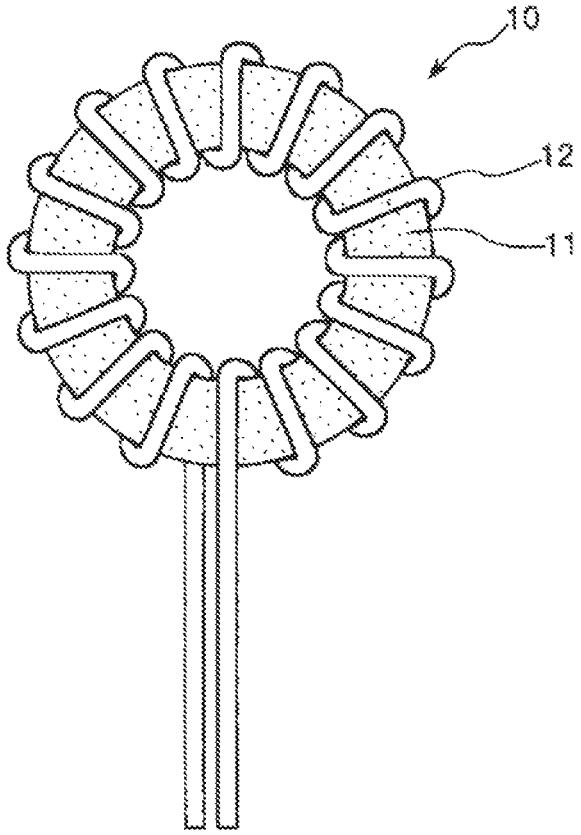
FIG. 1 is a plan view schematically illustrating a coil component of a toroidal type.

Soft magnetic powder, a dust core, a magnetic element, an electronic apparatus, and a movable body according to the present disclosure are described below in detail with reference to preferred exemplary embodiments illustrated in the accompanying drawings.

1. Soft Magnetic Powder

Soft magnetic powder according to the exemplary embodiment is metal powder exhibiting soft magnetism. Such soft magnetic powder is applicable for any purpose. For example, the soft magnetic powder is used for manufacturing various types of compacts such as a dust core and an electromagnetic wave absorbing material by bonding particles to each other via a binding material.

1.1. Composition

The soft magnetic powder according to the exemplary embodiment contains an amorphous metal particle having a composition expressed by a compositional formula $Fe_{100-a-b-c-d-e-f-g}Cr_aSi_bB_cC_dAl_eTi_fCo_g$.

a, b, c, d, e, f, and g are that express atom %. $0<a\le3.0$, $5.0\le b\le15.0$, $7.0\le c\le15.0$, $0.1\le d\le3.0$, $0<e\le0.016$, $0<f\le0.009$, and $0\le g\le0.025$ for a, b, c, d, e, f, and g.

The soft magnetic powder as described above contains the amorphous metal particle. Thus, as compared to a case in which a crystalline metal particle is contained, a magnetic property such as magnetic permeability is improved as magnetic anisotropy is reduced, and a coercive force is reduced at the same time.

Further, the amorphous metal particle has the above-mentioned composition, and hence the soft magnetic powder is turned into powder with a further reduced coercive force after heat treatment. Heat treatment reduces various defects and anisotropy (stress-induced anisotropy) that are caused at the time of manufacturing the soft magnetic powder. Therefore, the soft magnetic powder is designed in anticipation of reduction in coercive force due to heat treatment. However, the reduction degree is limited depending on the composition.

In contrast, the amorphous metal particle has the above-mentioned composition. Thus, in the soft magnetic powder according to the present exemplary embodiment, a coercive force can be sufficiently reduced due to heat treatment while crystallization of the amorphous metal due heat treatment is suppressed. Therefore, in the soft magnetic powder after heat treatment, both high magnetic permeability and a low coercive force can be achieved in a compatible manner. When the soft magnetic powder described above is used, a compact that contributes to size reduction and high efficiency of a magnetic element can be achieved. Note that, in the present specification, various defects and anisotropy are also referred to as "strain".

The soft magnetic powder may contain freely-selected soft magnetic powder or non-magnetic powder in addition to the amorphous metal particle having the above-mentioned composition. A content rate of the amorphous metal particle is preferably 50 mass % or greater, more preferably 80 mass % or greater, further more preferably 90 mass % or greater.

The composition of the amorphous metal particle is described below.

Iron (Fe) greatly influences a basic magnetic property and a basic mechanical property of the amorphous metal particle according to the exemplary embodiment.

A content rate of Fe is expressed by 100-a-b-c-d-e-f-g. Note that deviation of ±0.50 atom % or less from 100-a-b-c-d-e-f-g being a central value is allowed in anticipation of influence of impurities.

The content rate of Fe is not particularly limited, but is preferably from 70.0 atom % to 81.0 atom %, more preferably from 72.0 atom % to 75.0 atom %.

Note that, when the content rate of Fe is below the lower limit value, there may be a risk of reducing magnetic permeability and saturation magnetic flux density of the amorphous metal particle. In contrast, when the content rate of Fe exceeds the upper limit value, there may be a risk of causing difficulty in stably forming an amorphous structure at the time of manufacturing the amorphous metal particle.

Chromium (Cr) acts so as to improve anti-corrosiveness of the amorphous metal particle. It is considered that a passive state film containing chromium oxide as a main component causes this action. Improvement of anti-corrosiveness can suppress oxidization of the amorphous metal particle, and degradation of a magnetic property along with oxidization can be suppressed. Further, the passive state film also contributes to insulation among particles being the amorphous metal particle and suppression of eddy current loss of the compact.

A content rate a of Cr is expressed by $0<a\leq3.0$, preferably by $1.1\leq a\leq2.7$, more preferably by $1.2\leq a\leq2.5$. When the content rate a of Cr is below the lower limit value, there may be a risk of reducing anti-corrosiveness and degrading a magnetic property of the amorphous metal particle over time. In contrast, when the content rate a of Cr exceeds the upper limit value, amorphization is hindered at the time of manufacturing the amorphous metal particle. Thus, there may be a risk of increasing magnetic anisotropy and reducing magnetic permeability.

Silicon (Si) promotes amorphization at the time of manufacturing the amorphous metal particle. With this, when the soft magnetic powder is subjected to heat treatment, crystallization of the amorphous metal particle is suppressed. Further, Si also contributes to improvement of magnetic permeability of the amorphous metal particle.

A content rate b of Si is expressed by $5.0\leq b\leq15.0$, preferably by $8.0\leq b\leq13.5$, more preferably by $10.5\leq b\leq12.0$. When the content rate b of Si is below the lower limit value, there may be a risk of hindering amorphization and reducing magnetic permeability of the amorphous metal particle. In contrast, when the content rate b of Si exceeds the upper limit value, there may be a risk of reducing saturation magnetic flux density.

Boron (B) promotes amorphization at the time of manufacturing the amorphous metal particle. With this, when the soft magnetic powder is subjected to heat treatment, crystallization of the amorphous metal particle is suppressed. Further, B also contributes to improvement of magnetic permeability of the amorphous metal particle. Further, when Si and B are used together, amorphization can be promoted synergistically based on a difference between radiuses of the two atoms.

A content rate c of B is expressed by $7.0\leq c\leq15.0$, preferably by $8.0\leq c\leq13.5$, more preferably by $10.5\leq c\leq12.0$. When the content rate c of B is below the lower limit value, there may be a risk of hindering amorphization and reducing magnetic permeability of the amorphous metal particle. In contrast, when the content rate c of B exceeds the upper limit value, there may be a risk of reducing saturation magnetic flux density.

When raw materials for the amorphous metal particle are melted, carbon (C) reduces viscosity of the molten material, and facilitates amorphization and pulverization. With this, the amorphous metal particle having a small diameter and high magnetic permeability can be achieved. As a result, not only hysteresis loss but also eddy current loss can be suppressed in a high frequency region.

A content rate d of C is expressed by $0.1\leq d\leq3.0$, preferably by $1.3\leq d\leq2.8$, more preferably by $1.7\leq d\leq2.5$. When the content rate d of C is below the lower limit value, viscosity of the molten material is not sufficiently reduced. Hence, the amorphous metal particle is likely to have an abnormal shape. Thus, there may be a risk in that a filling property during compacting is degraded and saturation magnetic flux density of the compact cannot be increased sufficiently. In contrast, when the content rate d of C exceeds the upper limit value, there may be a risk of hindering amorphization and reducing magnetic permeability of the amorphous metal particle.

When a small amount of Aluminum (Al) is added, reduction in strain is promoted at the time of subjecting the amorphous metal particle to heat treatment. Therefore, in the soft magnetic powder after heat treatment, both high magnetic permeability and a low coercive force can be achieved in a compatible manner.

A content rate e of Al is expressed by $0<e\leq0.016$, preferably expressed by $0.001\leq e\leq0.009$, more preferably expressed by $0.003\leq e\leq0.007$. When the content rate e of Al is below the lower limit value, there may be a risk in that a coercive force cannot be reduced sufficiently at the time of subjecting the amorphous metal particle to heat treatment. In contrast, when the content rate e of Al exceeds the upper limit value, amorphization is hindered. Thus, there may be a risk of crystallization at the time of subjecting the amorphous metal particle to heat treatment.

When a small amount of titanium (Ti) is added, reduction in strain is promoted at the time of subjecting the amorphous metal particle to heat treatment. Therefore, in the soft magnetic powder after heat treatment, both high magnetic permeability and a low coercive force can be achieved in a compatible manner.

A content rate f of Ti is expressed by $0<f\leq0.009$, preferably by $0.001\leq f\leq0.008$, more preferably by $0.003\leq f\leq0.007$. When the content rate f of Ti is below the lower limit value, there may be a risk in that a coercive force cannot be reduced sufficiently at the time of subjecting the amorphous metal particle to heat treatment. In contrast, when the content rate f of Ti exceeds the upper limit value, amorphization is hindered. Thus, there may be a risk of crystallization at the time of subjecting the amorphous metal particle to heat treatment.

When a small amount of cobalt (Co) is also added together with Al or Ti, reduction in strain is promoted in cooperation with Al or Ti at the time of subjecting the amorphous metal particle to heat treatment. Therefore, in the soft magnetic powder after heat treatment, both high magnetic permeability and a low coercive force can be achieved in a compatible manner.

A content rate g of Co is expressed by $0 \leq g \leq 0.025$, preferably by $0.001 \leq g \leq 0.020$, more preferably by $0.003 \leq g \leq 0.015$. When the content rate g of Co is below the lower limit value, there may be a risk in that a coercive force cannot be reduced sufficiently at the time of subjecting the amorphous metal particle to heat treatment. In contrast, when the content rate g of Co exceeds the upper limit value, amorphization is hindered. Thus, there may be a risk of crystallization at the time of subjecting the amorphous metal particle to heat treatment.

Further, a quantitative ratio is optimized with Al and Ti, and hence reduction in strain during heat treatment can be particularly promoted.

Specifically, e and f in the compositional formula are expressed by $0.20 \leq e/f \leq 2.50$, preferably expressed by $0.40 \leq e/f \leq 2.00$, more preferably expressed by $0.60 \leq e/f \leq 1.50$. When e/f falls within the above-mentioned ranged, a quantitative balance between Al and Ti is optimized. Thus, high magnetic permeability and a low coercive force of the amorphous metal particle can be particularly promoted by heat treatment.

Further, a quantitative ratio is optimized with Al and Co, and hence reduction in strain during heat treatment can be particularly promoted.

Specifically, e and g in the compositional formula are expressed by $0.10 \leq e/g \leq 3.00$, preferably by $0.20 \leq e/g \leq 2.00$, more preferably by $0.30 \leq e/f \leq 1.00$. When e/g falls within the above-mentioned ranged, a quantitative balance between Al and Co is optimized. Thus, high magnetic permeability and a low coercive force of the amorphous metal particle can be particularly promoted by heat treatment.

Further, the amorphous metal particle according to the exemplary embodiment may contain impurities in addition to the composition expressed by the above-mentioned compositional formula $Fe_{100-a-b-c-a-e-f-g}Cr_aSi_bB_CC_dAl_eTi_fCo_g$. Various elements in addition to the above-mentioned elements are exemplified as impurities. A total content rate of impurities is preferably 0.50 atom % or less. Within this range, impurities are not likely to hinder effects of the present disclosure.

A content rate of each element in impurities is preferably 0.05 atom % or less. Within this range, impurities are not likely to hinder effects of the present disclosure. Thus, impurities thus contained are allowed.

The composition of the amorphous metal particle according to the exemplary embodiment is described above. The above-mentioned composition and impurities are specified by the following analysis method.

Examples of the analysis method include Iron and Steel-Atomic Absorption Spectrometric Method specified in JIS G 1257: 2000, Iron and Steel-ICP Atomic Emission Spectrometric Method specified in JIS G 1258: 2007, Iron and Steel—Method for Spark Discharge Atomic Emission Spectrometric Analysis specified in JIS G 1253: 2002, Iron and Steel—Method for X-ray Fluorescence Spectrometric Analysis specified in JIS G 1256: 1997, and Weight, Titrimetric Determination, and Absorption Photometry specified in JIS G 1211 to G 1237.

Specific examples include a solid emission spectrometric analysis device produced by SPECTRO, particularly, a spark discharge emission spectrometric analysis device (model: SPECTROLAB, type: LAVMB08A) and an ICP device CIROS 120 type produced by Rigaku Corporation.

Further, particularly for specification of carbon (C) and sulfur (S), Infrared Absorption Method after Oxygen Airflow Combustion (Combustion in High-Frequency Induction Furnace) specified in JIS G 1211: 2011 is also used. Specific example includes a carbon-sulfur analysis device CS-200 produced by LECO.

Further, particularly for nitrogen (N) and oxygen (O), Iron and Steel—Methods for Determination of Nitrogen Content specified in JIS G 1228: 1997 and General Rules for Determination of Oxygen in Metallic Materials specified in JIS Z 2613: 2006 are also used. Specific example includes an oxygen-nitrogen analysis device TC-300/EF-300 produced by LECO.

A particle surface of the soft magnetic powder may be provided with an insulating film as required. Examples of the insulating film include a glass material, a ceramics material, and a resin material.

1.2. Powder Property

An average particle diameter D50 of the soft magnetic powder according to the exemplary embodiment is not particularly limited, but is preferably from 1 μm to 50 μm, more preferably from 3 μm to 30 μm, further more preferably from 5 μm to 20 μm. The soft magnetic powder having such an average particle diameter is used. With this, a path through which an eddy current passes can be shortened. As a result, the soft magnetic powder that can sufficiently suppress eddy current loss caused in the particles is obtained.

When the average particle diameter of the soft magnetic powder is below the lower limit value, the soft magnetic powder is excessively fine. Thus, there may be a risk of degrading a filling property of the soft magnetic powder. With this, when molding density of a dust core as one example of the compact is reduced, there may be a risk of reducing magnetic permeability and magnetic flux density of the dust core. In contrast, when the average particle diameter of the soft magnetic powder exceeds the upper limit value, there may be a risk in that eddy current loss caused in the particles cannot be suppressed sufficiently to increase core loss of the dust core.

The average particle diameter D50 of the soft magnetic powder is defined as a particle diameter of accumulative 50% from a small diameter side in particle size distribution obtained by a laser diffraction method.

It is assumed that the soft magnetic powder according to the exemplary embodiment has a particle diameter D10 and a particle diameter D90 that are accumulative 10% from the small diameter side and accumulative 90% from the small diameter side in the particle size distribution obtained by the laser diffraction method, respectively. In this case, (D90−D10)/D50 is preferably from 1.0 to 1.5, more preferably from 1.0 to 1.3. (D90−D10)/D50 is an index indicating a degree of broadening in the particle size distribution, and this index falls within the range described above. With this, a satisfactory filling property of the soft magnetic powder is achieved. Thus, the compact particularly having a high magnetic property such as magnetic permeability and magnetic flux density can be obtained.

1.3. Physical Property

A coercive force of the soft magnetic powder according to the exemplary embodiment is not particularly limited, but is preferably 3.0 [Oe] or less (239 [A/m] or less), more preferably from 0.1 [Oe] to 2.0 [Oe] (from 8.0 [A/m] to 159 [A/m]). The soft magnetic powder having a small coercive force as described above is used. With this, the compact that can sufficiently suppress hysteresis loss even in a high frequency region can be manufactured.

A coercive force of the soft magnetic powder can be measured through use of a vibrating sample magnetometer such as TM-VSM1230-MHHL produced by TAMAKAWA CO., LTD.

Magnetic permeability of the soft magnetic powder according to the exemplary embodiment in a form of a compact is preferably 15 or greater, more preferably 17 or greater, at a measuring frequency of 100 kHz. The soft magnetic powder described above contributes to achievement of a dust core excellent in a magnetic property.

For example, when the compact has a toroidal shape, magnetic permeability of the compact indicates relative magnetic permeability obtained from self inductance of a closed magnetic path magnetic core coil, that is, effective magnetic permeability. An impedance analyzer is used to measure magnetic permeability, and a measuring frequency is set to 100 kHz. Further, it is assumed that the number of turns of the coil is seven and that a wire diameter of the coil is 0.6 mm.

2. Method of Manufacturing Soft Magnetic Powder

Next, one example of a method of manufacturing the soft magnetic powder described above is described.

The amorphous metal particle described above may be powder manufactured by any method. Examples of the manufacturing method include a pulverization method in addition to various atomization methods such as a water atomization method, a gas atomization method, and a rotating water flow atomization method. Particles manufactured by the atomization method selected from the above-mentioned methods are preferably used as the amorphous metal particle. With the atomization method, minute powder having a satisfactory particle shape can be efficiently manufactured. Therefore, the soft magnetic powder particularly having a high filling property can be obtained.

The atomization method is a method of manufacturing metal powder. Specifically, molten metal is caused to collide with liquid or gas jetted at a high speed, thereby pulverizing and cooling the molten metal.

Particularly, the water atomization method is a method of manufacturing metal powder from molten metal. Specifically, liquid such as water is used as cooling liquid, and is jetted in an inverted conical shape converging at one point. Then, the molten metal is caused to flow down to and collide at the converging point.

Further, the rotating water flow atomization method is a method of manufacturing metal powder. Specifically, cooling liquid is supplied along an inner circumferential surface of a tubular cooling body, and is caused to swirl along the inner circumferential surface. At the same time, liquid or air is jetted to molten metal, and the scattered molten metal is taken into the cooling liquid.

In the atomization method, a cooling speed for cooling the molten metal is preferably $1\times10^4$ degrees Celsius/s or higher, more preferably $1\times10^5$ degrees Celsius/s or higher. Such rapid cooling enables solidification while maintaining atomic arrangement in the molten metal state. Thus, the amorphous metal particle particularly having a high amorphization degree can be achieved, and variation in a composition ratio among the amorphous metal particles can also be suppressed. As a result, the homogeneous soft magnetic powder can be obtained.

The amorphous metal particle manufactured by the above-mentioned method is subjected to heat treatment. With this, a magnetic property can be improved, and a coercive force can further be reduced.

When a crystallization temperature of the amorphous metal particle is denoted with Tx, a heating temperature for heat treatment is preferably Tx-100 degrees Celsius or higher and lower than Tx, more preferably Tx-50 degrees Celsius or higher and lower than Tx.

When the heating temperature falls within the above-mentioned range, a heating time period for heat treatment is preferably from 5 minutes to 120 minutes, more preferably from 5 minutes to 60 minutes.

When heat treatment is performed under the heating conditions as described above, a residual stress due to rapid cooling solidification generated at the time of manufacturing the amorphous metal particle can be alleviated. With this, strain of the amorphous metal particle can be alleviated, a coercive force can be reduced, and a magnetic property can be improved.

Further, the manufactured soft magnetic powder may be subjected to classification as required. Examples of the classification method include dry classification such as sifting classification, inertia classification, and centrifugal classification, and wet classification such as sedimentation classification.

3. Dust Core and Magnetic Element

Next, a dust core and a magnetic element according to the exemplary embodiment are described.

The magnetic element according to the exemplary embodiment is applicable to various magnetic elements including a magnetic core, such as a choke coil, an inductor, a noise filter, a reactor, a transformer, a motor, an actuator, a solenoid valve, and a generator. Further, the dust core according to the exemplary embodiment is applicable to a magnetic core of such magnetic element.

Two types of coil components are representatively described below as examples of the magnetic element.

3.1. Toroidal Type

First, as one example of the magnetic element according to the exemplary embodiment, a coil component of a toroidal type is described.

FIG. 1 is a plan view schematically illustrating a coil component of a toroidal type.

A coil component 10 illustrated in FIG. 1 includes a dust core 11 having a ring-like shape and a conducting wire 12 wound about the dust core 11. In general, the coil component 10 described above is referred to as a toroidal coil.

The soft magnetic powder according to the exemplary embodiment and a binding material are mixed. Then, the obtained mixture is supplied into a molding die, is pressurized, and is molded. In this manner, the dust core 11 is obtained. Specifically, the dust core 11 is a compact containing the soft magnetic powder according to the exemplary embodiment. In the dust core 11 as described above, the soft magnetic powder has a low coercive force and high magnetic permeability. Thus, the coil component 10 including the dust core 11 has low core loss in a high frequency region and a high magnetic property such as magnetic permeability and magnetic flux density. Therefore, when the coil component 10 is mounted to an electronic apparatus or the like, power consumption of the electronic apparatus or the like can be reduced, performance thereof can be improved, and a size thereof can be reduced.

Examples of a constituent material for the binding material used for manufacturing the dust core 11 include organic materials such as a silicon resin, an epoxy resin, a phenolic resin, a polyamide resin, a polyimide resin, and a polyphenylene sulfide resin, and inorganic materials including phosphates such as magnesium phosphate, calcium phosphate, zinc phosphate, manganese phosphate, and cadmium phosphate and silicates such as sodium silicate. Particularly, a thermosetting polyimide resin or an epoxy resin is preferred. Those resin materials are readily cured through heating, and are also excellent in heat resistance. Therefore, manufacturability and heat resistance of the dust core 11 can be improved. Note that the binding material may be added as required, and may be omitted.

Further, a ratio of the binding material with respect to the soft magnetic powder slightly differs depending on a target magnetic property or a target mechanical property of the dust core 11 to be manufactured, allowable eddy current loss, or the like, but is preferably about from 0.5 mass % to 5 mass %, more preferably about from 1 mass % to 3 mass %. With this, the coil component 10 having an excellent magnetic property can be obtained while the particles of the soft magnetic powder are sufficiently bonded to each other.

Various additives may be added to the mixture for any purpose as required.

Examples of a constituent material for the conducting wire 12 include highly conductive materials such as a metal material containing Cu, Al, Ag, Au, Ni, or the like. Further, an insulating film is provided on the surface of the conducting wire 12 as required.

Note that the shape of the dust core 11 is not limited to the ring-like shape illustrated in FIG. 1. For example, the dust core 11 may have a ring-like shape that is partially chipped or a shape having a linear part in a longitudinal direction. Alternatively, a sheet-like shape, a film-like shape, or the like may be adopted.

Further, the dust core 11 may contain soft magnetic powder other than the above-mentioned soft magnetic powder according to the exemplary embodiment or non-magnetic powder as required.

As described above, the coil component 10 as the magnetic element includes the dust core 11 containing the soft magnetic powder described above. With this, the coil component 10 having low core loss and an excellent magnetic property can be achieved.

3.2. Closed Magnetic Path Type

Next, as one example of the magnetic element according to the exemplary embodiment, a coil component of a closed magnetic path type is described.

Figure 2:
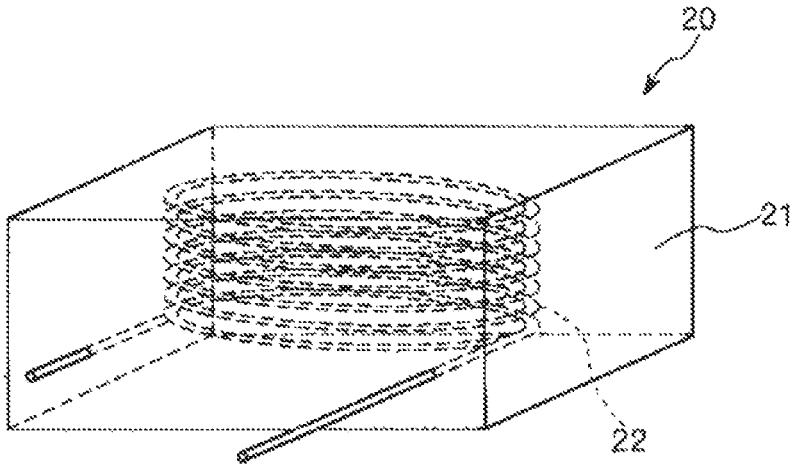
FIG. 2 is a see-through perspective view schematically illustrating a coil component of a closed magnetic path type.

FIG. 2 is a see-through perspective view schematically illustrating the coil component of a closed magnetic path type.

A coil component of a closed magnetic path type is described below. In the following description, differences from the coil component of a toroidal type are mainly described, and description for similar matters is omitted.

As illustrated in FIG. 2, a coil component 20 according to the present exemplary embodiment is obtained by embedding a conducting wire 22 formed to have a coil shape inside the dust core 21. Specifically, the coil component 20 as the magnetic element includes a dust core 21 containing the soft magnetic powder described above, and is obtained by molding the conducting wire 22 with the dust core 21. The dust core 21 has a configuration similar to that of the dust core 11 described above. With this, the coil component 20 having low core loss and an excellent magnetic property can be achieved.

When the coil component 20 has such a structure, a coil component having a relatively small size can be obtained easily. Further, the coil component 20 has a high magnetic property and low core loss. Therefore, when the coil component 20 is mounted to an electronic apparatus or the like, power consumption of the electronic apparatus or the like can be reduced, performance thereof can be improved, and a size thereof can be reduced.

Further, the conducting wire 22 is embedded inside the dust core 21, and hence a gap is less likely to be present between the conducting wire 22 and the dust core 21. Thus, vibration due to magnetic strain of the dust core 21 can be suppressed, and generation of noise along with this vibration can also be suppressed.

Note that the shape of the dust core 21 is not limited to the shape illustrated in FIG. 2, and a sheet-like shape, a film-like shape, or the like may be adopted.

Further, the dust core 21 may contain soft magnetic powder other than the above-mentioned soft magnetic powder according to the exemplary embodiment or non-magnetic powder as required.

4. Electronic Apparatus

Next, an electronic apparatus including the magnetic element according to the exemplary embodiment is described with reference to FIG. 3 to FIG. 5.

Figure 3:
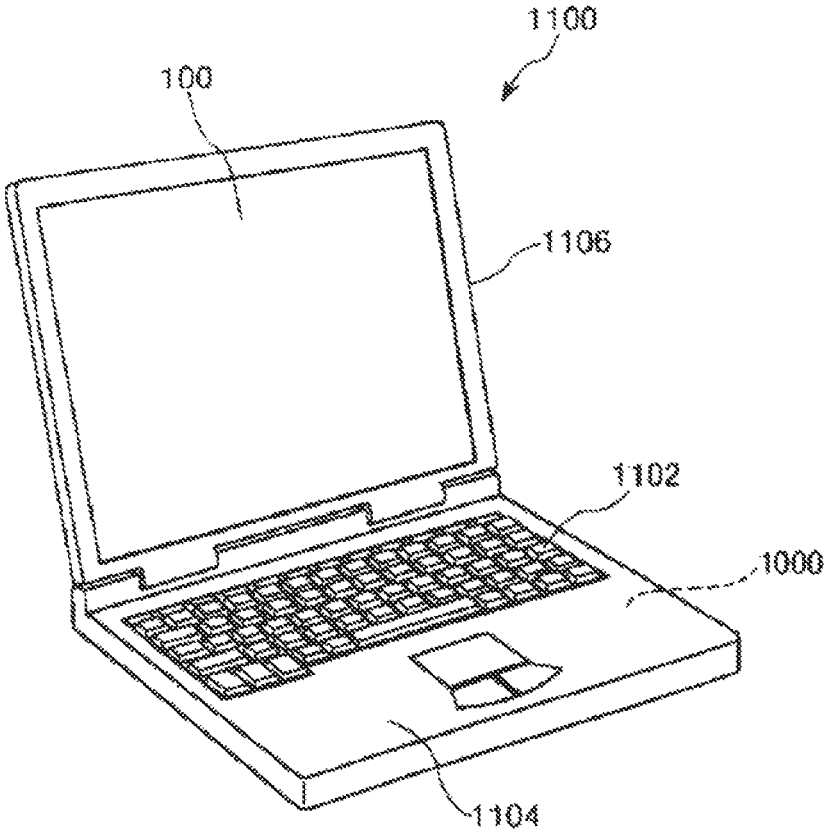
FIG. 3 is a perspective view illustrating a mobile personal computer as an electronic apparatus including a magnetic element according to an exemplary embodiment.

FIG. 3 is a perspective view illustrating a mobile personal computer as the electronic apparatus including the magnetic element according to the exemplary embodiment. A personal computer 1100 illustrated in FIG. 3 includes a main body unit 1104 including a key board 1102 and a display unit 1106 including a display screen 100. The display unit 1106 is supported by the main body unit 1104 through intermediation of a hinge structure portion in a turnable manner. The personal computer 1100 having such a configuration internally includes the magnetic element 1000 such as a choke coil for switching power, an inductor, and a motor.

Figure 4:
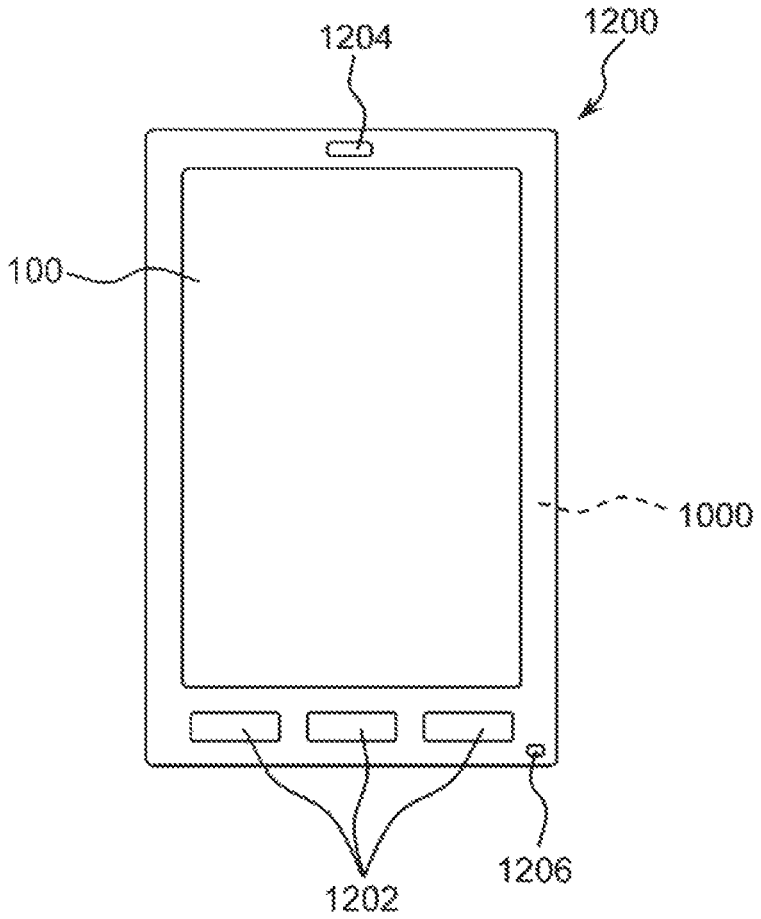
FIG. 4 is a plan view illustrating a smartphone as an electronic apparatus including the magnetic element according to the exemplary embodiment.

FIG. 4 is a plan view illustrating a smartphone as the electronic apparatus including the magnetic element according to the exemplary embodiment. A smartphone 1200 illustrated in FIG. 4 includes a plurality of operation buttons 1202, a reception port 1204, and a transmission port 1206. Further, the display screen 100 is arranged between the operation buttons 1202 and the reception port 1204. The smartphone 1200 having such a configuration internally includes the magnetic element 1000 such as an inductor, a noise filter, and a motor.

Figure 5:
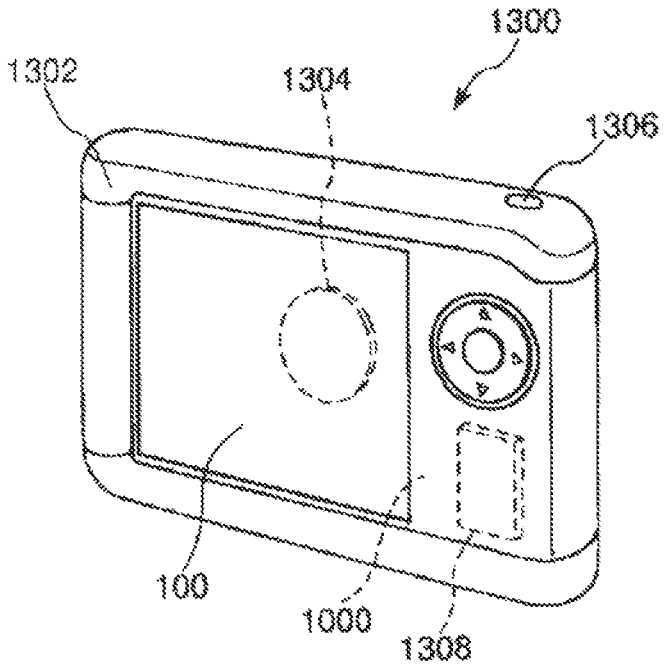
FIG. 5 is a perspective view illustrating a digital still camera as an electronic apparatus including the magnetic element according to the exemplary embodiment.

FIG. 5 is a perspective view illustrating a digital still camera as the electronic apparatus including the magnetic element according to the exemplary embodiment. A digital still camera 1300 generates an imaging signal by photoelectrically converting an optical image of a subject with an imaging element such as a Charge Coupled Device (CCD).

The digital still camera 1300 illustrated in FIG. 5 includes the display screen 100 provided to a back surface of a case 1302. The display screen 100 functions as a finder that displays a subject as an electronic image. Further, on the front surface side of the casing 1302, that is, the back side in the drawing, a photo-detection unit 1304 including an optical lens and a CCD is provided.

A photographer confirms a subject image displayed on the display screen 100, and presses down a shutter button 1306. Then, an imaging signal of the CCD at the particular time is transferred to and stored in a memory 1308. The digital still camera 1300 having such a configuration internally includes the magnetic element 1000 such as an inductor and a noise filter.

In addition to the personal computer in FIG. 3, the smartphone in FIG. 4, and the digital still camera in FIG. 5, examples of the electronic apparatus according to the exemplary embodiment include a mobile phone, a tablet terminal, a watch, an ink jet-type ejection device such as an ink-jet printer, a laptop personal computer, a television, a video camera, a video tape recorder, a car navigation device, a pager, an electronic organizer, an electronic dictionary, an electronic calculator, electronic game equipment, a word processor, a work station, a video telephone, a security television monitor, electronic binoculars, a POS terminal, medical equipment such as an electronic thermometer, a sphygmomanometer, a blood sugar meter, an electrocardiographic apparatus, an ultrasound diagnosis apparatus, and an electronic endoscope, a fish finder, various types of measurement equipment, instruments for a vehicle, an aircraft, and a watercraft, movable body control equipment such as automobile control equipment, aircraft control equipment, railway vehicle control equipment, and watercraft control equipment, and a flight simulator.

As described above, the electronic apparatus includes the magnetic element according to the exemplary embodiment. With this, the effects of the magnetic element that are a low coercive force and high magnetic permeability can be exerted, and the electronic apparatus with high performance can be achieved.

5. Movable Body

Next, a movable body including the magnetic element according to the present exemplary embodiment is described with reference to FIG. 6.

Figure 6:
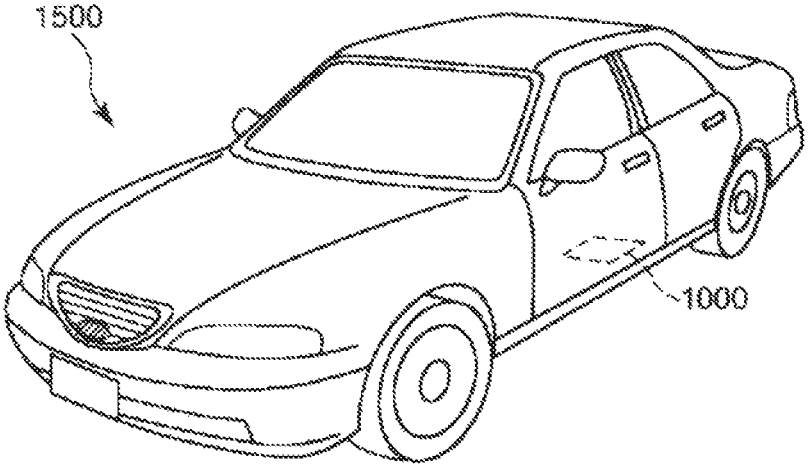
FIG. 6 is a perspective view illustrating an automobile as a movable body including the magnetic element according to the exemplary embodiment.

FIG. 6 is a perspective view illustrating an automobile as a movable body including the magnetic element according to the exemplary embodiment.

An automobile 1500 internally includes the magnetic element 1000. Specifically, the magnetic element 1000 is internally included in various types of vehicle components such as a car navigation system, an anti-lock brake system (ABS), an engine control unit, a battery control unit for a hybrid car or an electric vehicle, a vehicle posture control system, an electronic control unit (ECU) such as an automatic operation system, a drive motor, a generator, and an air-conditioning unit.

As described above, the mobile body includes the magnetic element according to the exemplary embodiment. With this, the effects of the magnetic element that are a low coercive force and high magnetic permeability can be exerted, and the mobile body with high performance can be achieved.

Note that examples of the movable body according to the present exemplary embodiment may include a motorcycle, a bicycle, an aircraft, a helicopter, a drone, a watercraft, a submarine, a railway vehicle, a rocket, and a spacecraft in addition to the automobile illustrated in FIG. 6.

The soft magnetic powder, the dust core, the magnetic element, the electronic apparatus, and the movable body according to the present disclosure are described above according to the preferred embodiments. However, the present disclosure is not limited to these exemplary embodiments.

For example, in the exemplary embodiment, the compact such as the dust core is given as an application example of the soft magnetic powder according to the present disclosure. However, the application example is not limited thereto, and may include a magnetic fluid, a magnetic head, and a magnetic device such as a magnetic shield sheet.

Further, the shapes of the dust core and the magnetic element are not limited to the illustration, and may be freely selected.

EXAMPLES

Next, specific examples of the present disclosure are described.

6. Manufacturing Soft Magnetic Powder 6.1. Sample No. 1

First, row materials were melted in a high frequency induction furnace, and the resultant was powdered by the water atomization method. In this manner, amorphous metal particles were obtained. Subsequently, a sifter was used for classification.

Then, the amorphous metal particle after classification was subjected to heat treatment at 300 degrees Celsius for 30 minutes in a nitrogen atmosphere. In this manner, soft magnetic powder was obtained as Sample No. 1.

A composition of the amorphous metal particle thus obtained is shown in Table 1. Note that the solid emission spectrometric analysis device (spark discharge emission spectrometric analysis device) produced by SPECTRO (model: SPECTROLAB, type: LAVMB08A) was used for specification of the composition. Further, the carbon-sulfur analysis device CS-200 produced by LECO was used for a quantitative analysis of carbon (C).

6.2. Samples No. 2 to No. 21

Soft magnetic powder was obtained in a similar manner to Sample No. 1, except that a composition of an amorphous metal particle was as shown in Table 1 or Table 2.

Note that, in Table 1 and Table 2, the soft magnetic powder denoted with each sample numeral that corresponds to the present disclosure is denoted as "Example", and one that does not correspond to the present disclosure is denoted with "Comparative Example".

7. Evaluation on Soft Magnetic Powder 7.1. Particle Size Distribution

Particle size distribution was measured for the soft magnetic powder denoted with each sample numeral. Note that this measurement was performed by using a particle size distribution measuring device of a laser diffraction type produced by Nikkiso Co., Ltd., a micro track, and HRA9320-X100. Then, based on the particle size distribution, the particle diameters D10, D50, and D90, and (D90-D10)/D50 of the soft magnetic powder were calculated. The calculation results are shown in Table 1 or Table 2.

7.2. Coercive Force

VSM System TM-VSM1230-MHHL produced by TAMAKAWA CO., LTD was used as a magnetization measuring device to measure a coercive force of the soft magnetic powder denoted with each sample numeral. The measurement results are shown in Table 1 or Table 2.

8. Manufacturing Dust Core and Magnetic Element

The soft magnetic powder denoted with each sample numeral was used to manufacture a dust core and a magnetic element in the following manner.

First, the soft magnetic powder, an epoxy resin (binding material), and methyl ethyl ketone (organic solvent) were mixed to obtain a mixture. Note that an addition amount of the epoxy resin was 2 parts by mass with respect to 100 parts by mass of the soft magnetic powder 100.

Next, the mixture thus obtained was stirred, was heated at a temperature of 150 degrees Celsius for 30 minutes. Then, a dried body in a block form was obtained. Subsequently, the dried body was caused to pass through a shifter having an opening of 500 μm, and the dried body was pulverized. In this manner, granulated powder was obtained.

Next, a molding die was filled with the granulated powder thus obtained, and a mold was obtained under the following molding conditions.

Molding method: Press molding

Shape of mold: Ring-like shape

Dimension of mold: Outer diameter φ14 mm, inner diameter φ7 mm, thickness 3 mm

Molding pressure: Molding pressure of 294 MPa

Next, the binding material in the mold was cured through heating. With this, the dust core (toroidal coil) was obtained.

Next, the dust core thus obtained was used to manufacture the magnetic element illustrated in FIG. 1 under the following manufacturing conditions.

Constituent material of conducting wire: Cu

Wire diameter of conducting wire: 0.6 mm

Number of turns (at the time of measuring magnetic permeability): Seven turns

Number of turns (at the time of measuring core loss): 36 turns on the primary side, 36 turns on the secondary side)

9. Evaluation on Magnetic Element 9.1. Magnetic Permeability

For the magnetic element manufactured by using the soft magnetic powder denoted with each sample numeral, 4294A Precision Impedance Analyzer produced by Agilent Technologies was used to measure magnetic permeability at a frequency of 100 kHz. Then, the magnetic permeability thus obtained was evaluated with reference to the following evaluation criteria.

A: Magnetic permeability of 20 or greater

B: Magnetic permeability of 17 or greater and less than 20

C: Magnetic permeability of 14 or greater and less than 17

D: Magnetic permeability of less than 14

The evaluation results are shown in Table 1 or Table 2.

9.2. Core Loss

For the magnetic element manufactured by using the soft magnetic powder denoted with each sample numeral, core loss Pcv was measured. Note that the measurement conditions were a measuring frequency of 1 MHz and maximum magnetic flux density Bm of 50 mT. Then, the core loss thus obtained was evaluated with reference to the following evaluation criteria.

A: Extremely low core loss (less than 200 kW/m$^3$ in Table 1, less than 400 kW/m$^3$ in Table 2)

B: Relatively low core loss (200 kW/m$^3$ or greater and less than 250 kW/m$^3$ in Table 1, 400 kW/m$^3$ or greater and less than 500 kW/m$^3$ in Table 2)

C: Relatively high core loss (250 kW/m$^3$ or greater and less than 300 kW/m$^3$ in Table 1, 500 kW/m$^3$ or greater and less than 600 kW/m$^3$ in Table 2)

D: Extremely high core loss (300 kW/m$^3$ or greater in Table 1, 600 kW/m$^3$ or greater in Table 2)

The evaluation results are shown in Table 1 or Table 2.

TABLE 1

| Sample No. | | Composition of amorphous metal particle | | | | | | | | | | Method of manufacturing amorphous metal particle |
|---|---|---|---|---|---|---|---|---|---|---|---|---|
| | | Fe | Cr a | Si b | B c | C d | Al e | Ti f | Co g | e/f | e/g | |
| | | atom % | | | | | | | | | | |
| No. 1 | Example | 73.87 | 2.28 | 10.89 | 11.05 | 1.89 | 0.005 | 0.004 | 0.012 | 1.25 | 0.42 | Water atomization |
| No. 2 | Example | 74.10 | 2.01 | 11.06 | 10.78 | 2.03 | 0.002 | 0.006 | 0.009 | 0.33 | 0.22 | Water atomization |
| No. 3 | Example | 73.49 | 2.45 | 11.21 | 10.59 | 2.23 | 0.003 | 0.005 | 0.020 | 0.60 | 0.15 | Water atomization |
| No. 4 | Example | 74.07 | 1.86 | 11.34 | 10.75 | 1.97 | 0.007 | 0.003 | 0.003 | 2.33 | 2.33 | Water atomization |
| No. 5 | Example | 73.10 | 1.54 | 11.75 | 11.23 | 2.36 | 0.004 | 0.006 | 0.012 | 0.67 | 0.33 | Water atomization |
| No. 6 | Example | 73.80 | 2.35 | 11.11 | 10.85 | 1.87 | 0.012 | 0.005 | 0.008 | 2.40 | 1.50 | Water atomization |
| No. 7 | Example | 73.83 | 2.31 | 10.74 | 11.34 | 1.75 | 0.015 | 0.004 | 0.012 | 3.75 | 1.25 | Water atomization |
| No. 8 | Example | 73.78 | 1.97 | 11.23 | 10.95 | 2.04 | 0.002 | 0.009 | 0.021 | 0.22 | 0.10 | Water atomization |
| No. 9 | Example | 73.79 | 2.25 | 11.03 | 11.04 | 1.88 | 0.005 | 0.004 | 0.000 | 1.25 | — | Water atomization |
| No. 10 | Example | 73.96 | 2.14 | 10.78 | 11.10 | 2.00 | 0.009 | 0.004 | 0.003 | 2.25 | 3.00 | Water atomization |
| No. 11 | Example | 75.52 | 0.25 | 12.05 | 10.20 | 1.96 | 0.006 | 0.005 | 0.008 | 1.20 | 0.75 | Water atomization |
| No. 12 | Example | 74.52 | 2.22 | 12.25 | 9.03 | 1.97 | 0.005 | 0.004 | 0.005 | 1.25 | 1.00 | Water atomization |
| No. 13 | Example | 74.96 | 1.97 | 8.87 | 12.15 | 2.03 | 0.006 | 0.003 | 0.007 | 2.00 | 0.86 | Water atomization |
| No. 14 | Comparative Example | 73.81 | 2.28 | 11.12 | 10.78 | 1.99 | 0.000 | 0.004 | 0.015 | 0.00 | 0.00 | Water atomization |
| No. 15 | Comparative Example | 73.56 | 2.26 | 10.98 | 11.06 | 2.12 | 0.005 | 0.000 | 0.012 | — | 0.42 | Water atomization |
| No. 16 | Comparative Example | 73.84 | 2.31 | 11.03 | 10.78 | 2.01 | 0.021 | 0.005 | 0.009 | 4.20 | 2.33 | Water atomization |
| No. 17 | Comparative Example | 74.04 | 1.87 | 10.78 | 11.23 | 2.05 | 0.005 | 0.013 | 0.008 | — | 0.63 | Water atomization |
| No. 18 | Comparative Example | 73.85 | 2.05 | 11.04 | 11.06 | 1.96 | 0.006 | 0.004 | 0.035 | — | 0.17 | Water atomization |

TABLE 1-continued

| Sample No. | | Evaluation results of soft magnetic powder and magnetic element | | | | | | |
|---|---|---|---|---|---|---|---|---|
| | | D10 μm | D50 μm | D90 μm | (D90−D10)/D50 — | Coercive force Oe | Magnetic permeability 100 kHz — | Core loss Bm = 50 mT 1 MHz kW/m³ |
| No. 1 | Example | 1.71 | 3.11 | 5.09 | 1.09 | 1.3 | A | A |
| No. 2 | Example | 1.67 | 3.08 | 5.00 | 1.08 | 1.8 | B | B |
| No. 3 | Example | 1.87 | 3.36 | 5.40 | 1.05 | 1.5 | B | B |
| No. 4 | Example | 1.67 | 3.08 | 5.00 | 1.08 | 1.9 | B | B |
| No. 5 | Example | 2.05 | 3.71 | 5.92 | 1.04 | 1.3 | A | A |
| No. 6 | Example | 1.69 | 3.14 | 5.10 | 1.09 | 1.8 | B | B |
| No. 7 | Example | 1.50 | 2.80 | 4.30 | 1.00 | 2.2 | B | C |
| No. 8 | Example | 1.66 | 3.05 | 4.97 | 1.09 | 2.5 | B | C |
| No. 9 | Example | 1.75 | 3.19 | 5.16 | 1.07 | 1.6 | B | B |
| No. 10 | Example | 1.76 | 3.18 | 5.16 | 1.07 | 2.1 | B | C |
| No. 11 | Example | 1.66 | 3.35 | 5.31 | 1.09 | 2.0 | B | B |
| No. 12 | Example | 1.74 | 3.21 | 5.26 | 1.10 | 1.9 | B | B |
| No. 13 | Example | 1.66 | 3.01 | 5.23 | 1.19 | 2.0 | B | C |
| No. 14 | Comparative Example | 1.50 | 2.76 | 4.32 | 1.02 | 3.1 | C | D |
| No. 15 | Comparative Example | 2.10 | 3.75 | 5.96 | 1.03 | 3.1 | C | D |
| No. 16 | Comparative Example | 1.74 | 3.25 | 5.27 | 1.09 | 5.2 | D | D |
| No. 17 | Comparative Example | 1.83 | 3.31 | 5.33 | 1.06 | 4.9 | D | D |
| No. 18 | Comparative Example | 1.80 | 3.28 | 5.31 | 1.07 | 6.3 | D | D |

TABLE 2

| Sample No. | | Composition of amorphous metal particle | | | | | | | | | | Method of |
|---|---|---|---|---|---|---|---|---|---|---|---|---|
| | | Fe | Cr a | Si b | B c | C d | Al e | Ti f | Co g | e/f | e/g | manufacturing amorphous metal particle |
| | | atom % | | | | | | | | | | |
| No. 19 | Example | 73.77 | 2.25 | 11.10 | 10.89 | 1.97 | 0.004 | 0.005 | 0.010 | 0.80 | 0.40 | Rotating water flow |
| No. 20 | Example | 73.64 | 2.35 | 10.75 | 11.25 | 1.99 | 0.007 | 0.004 | 0.006 | 1.75 | 1.17 | Rotating water flow |
| No. 21 | Example | 73.80 | 1.89 | 11.38 | 10.76 | 2.15 | 0.003 | 0.008 | 0.012 | 0.38 | 0.25 | Rotating water flow |

| Sample No. | | Evaluation results of soft magnetic powder and magnetic element | | | | | | |
|---|---|---|---|---|---|---|---|---|
| | | D10 μm | D50 μm | D90 μm | (D90−D10)/D50 — | Coercive force Oe | Magnetic permeability 100 kHz — | Core loss Bm = 50 mT 1 MHz kW/m³ |
| No. 19 | Example | 13.31 | 24.20 | 39.60 | 1.09 | 1.0 | A | A |
| No. 20 | Example | 11.26 | 20.50 | 33.03 | 1.06 | 1.1 | A | A |
| No. 21 | Example | 19.30 | 35.20 | 57.12 | 1.07 | 1.2 | A | B |

As apparent from Table 1 and Table 2, the soft magnetic powder in Examples had a coercive force lower than that of the soft magnetic powder in Comparative Examples. Further, the magnetic elements manufactured by using the soft magnetic powder in Examples also had satisfactory magnetic permeability and satisfactory core loss.

Note that, when the soft magnetic powder in Examples and Comparative Examples were not subjected to heat treatment, a coercive force was 8.0 [Oe] or greater. Therefore, according to the present disclosure, it has been found that the soft magnetic powder having a sufficiently low coercive force due to heat treatment and enabling high magnetic permeability can be achieved.

What is claimed is:

1. Soft magnetic powder comprising an amorphous metal particle having a composition expressed by a compositional formula $Fe_{100-a-b-c-d-e-f-g}Cr_aSi_bB_cC_dAl_eTi_fCo_g$, wherein a, b, c, d, e, f, and g are expressed as atom %, where $0<a\leq 3.0$, $5.0\leq b\leq 15.0$, $7.0\leq c\leq 15.0$, $0.1\leq d\leq 3.0$, $0<e\leq 0.016$, $0<f\leq 0.009$, $0\leq g\leq 0.025$, e and f in the compositional formula satisfy $0.20\leq e/f\leq 2.50$, and e and g in the compositional formula satisfy $0.10 \leq e/g \leq 3.00$.

2. A dust core comprising the soft magnetic powder according to claim 1.

3. A magnetic element comprising the dust core according to claim 2.

4. An electronic apparatus comprising the magnetic element according to claim 3.

5. A movable body comprising the magnetic element according to claim 3.

* * * * *